US005553969A

United States Patent [19]

Reed

[11] Patent Number: 5,553,969

[45] Date of Patent: Sep. 10, 1996

[54] PAVING APPARATUS

[76] Inventor: Jeffrey Reed, P.O. Box 1620, West Sacramento, Calif. 95691

[21] Appl. No.: 388,211

[22] Filed: Feb. 13, 1995

[51] Int. Cl.[6] ..... E01C 19/48

[52] U.S. Cl. ..... 404/110; 404/84.05; 404/101; 404/108

[58] Field of Search ..... 404/72, 84.05, 404/84.1, 92, 101, 108, 110

[56] References Cited

U.S. PATENT DOCUMENTS 5,044,819 9/1991 Kilheffer et al. ..... 404/72
5,120,155 6/1992 Samspon ..... 404/101

*Primary Examiner*—Michael Powell Buiz
*Assistant Examiner*—Pamela A. O'Connor
*Attorney, Agent, or Firm*—Bielen, Peterson & Lampe

[57] ABSTRACT

A paving apparatus utilizing surface paving components which are stored in a plurality of containers. The containers are supported on a movable platform which may be motivated by a motor carried on the platform. The platform includes a first end having the motor and a second end portion which provides an operator stand. Containers are supported on the platform to hold each of the plurality of surface paving components which are mixed in a holding tank and sent to a conveyor on the movable platform. A control is located at the operator stand to determine the speed and to steer the movable platform. Mixing of paving components and the spreading of the same on a surface are also controlled at the operator stand.

10 Claims, 6 Drawing Sheets

FIG-4
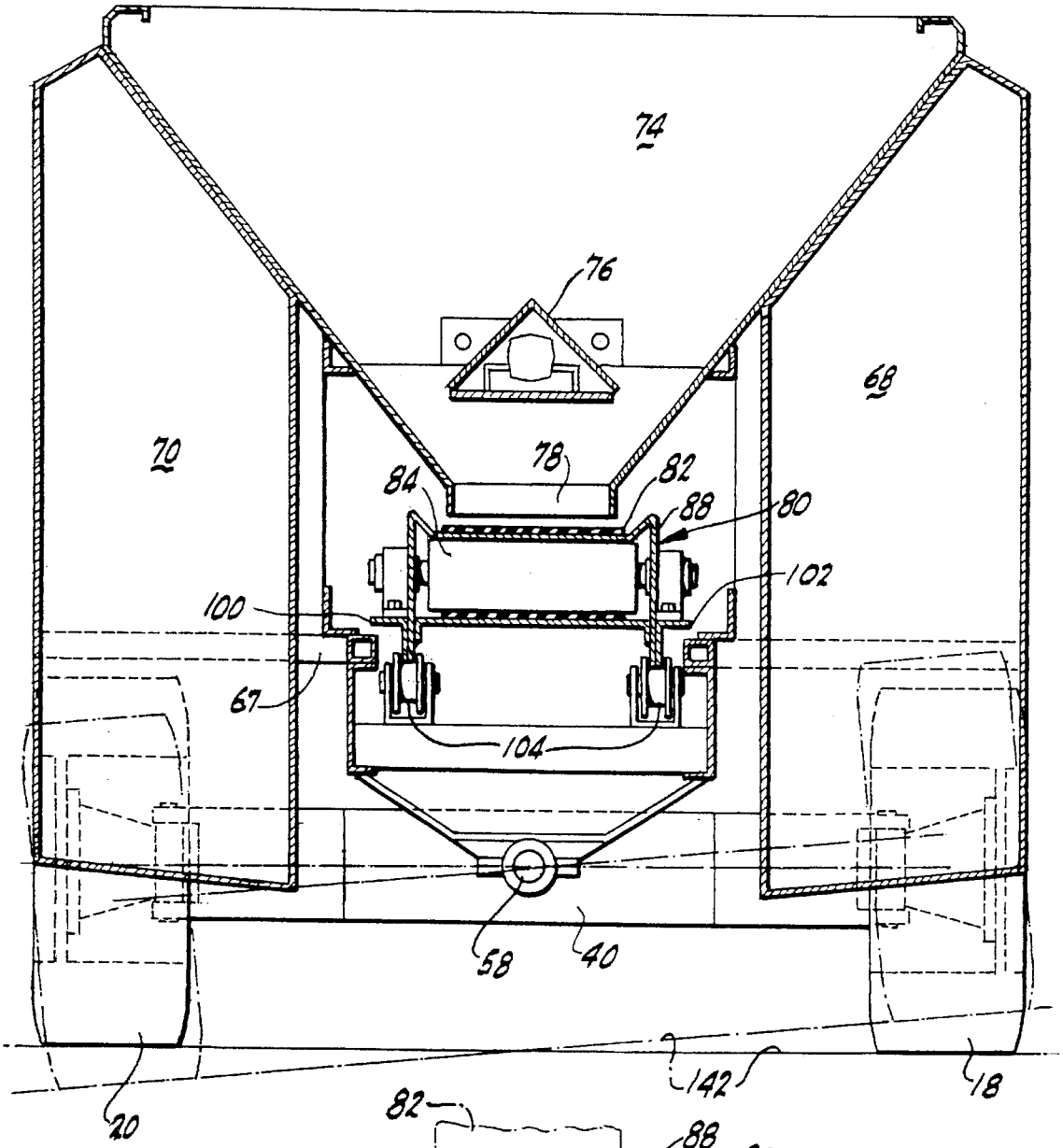
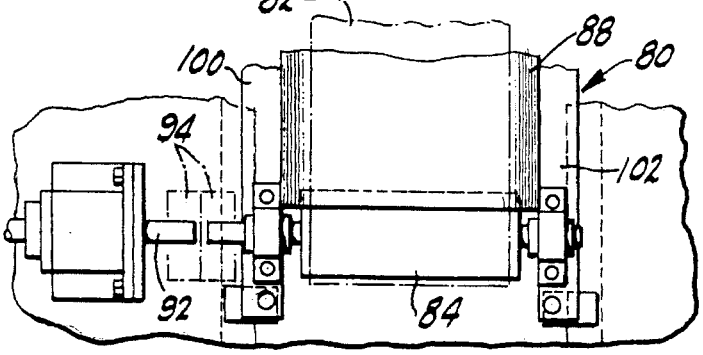
FIG-6

14
138
136
140
132
-8-
122
126
124
130
128
22
32
24
46
44
12

134

80
82
12
68
70
104
104
54
56
18
40
42
48
50
38
20
56
46
44
16

PAVING APPARATUS

BACKGROUND OF THE INVENTION

The present invention relates to a novel paving apparatus. Surfaces such as parking lots, Cul de sac, golf cart runways, walkways, bicycle trails, and the like often require paving or repaving after a period of time.

In the past, paving machines have been unable to easily accomplish this task due to their size and configuration relative to the small areas being paved. Also, such areas are many times paved manually which is very expensive to accomplish.

A self-propelled compact surfacing machine which may be operated by one person would be a notable advance in the transportation field.

SUMMARY OF THE INVENTION

In accordance with the present invention a novel and useful compact paving apparatus is herein provided.

The paving apparatus of the present invention utilizes a movable platform which possesses a first end portion and a second end portion. Platform may be mounted on a wheel and axle automotive system and include a motor to turn such wheels which is mounted on the second end portion of the movable platform.

A plurality of containers is also employed in the present invention to store the plurality of surface paving components. For example, aggregate, water, fines, emulsions, additives, and the like are all stored and held on the movable platform.

A holding tank is also found in the present invention and is capable of communicating with the plurality of containers in order to combine the plurality of surface paving components as desired. The combined components are passed to a central conveyor which is located at a central hopper or holding tank. The components are then passed to mixing means for blending the plurality of surface paving components in a pug mill or similar device. The mixing means is located at the first end portion of the movable platform and may be fitted with a spreader box or like component. The spreader box may be formed with a lifting arm which is capable of raising and lowering the paving box from the surface.

An operator stand locates at the first end portion of the movable platform. The operator stand includes control means for steering the movable platform and controlling its rate of speed. The control means is located at the first end portion of the movable platform at the operator's stand. In addition, a control operator is located at the operator's stand to lift and lower the spreader box and to mete various components entering the holding tank or hopper.

It may be apparent that a novel and useful paving apparatus has been described.

It is therefore an object of the present invention to provide a paving apparatus that is compact and capable of operating effectively in confined areas.

Another object of the present invention is to provide a paving apparatus which may be operated by one person at an operator's stand located on one end portion of the paving apparatus.

The further object of the present invention is to provide a paving apparatus which may be staged and loaded in a very short period of time.

A further object of the present invention is to provide a paving apparatus which minimizes labor costs.

The invention possesses other objects and advantages especially as concerns particular characteristics and features thereof which will become apparent as the specification continues.

BRIEF DESCRIPTION OF THE DRAWINGS

FIG. 4 is a sectional view taken along line 4—4 of FIG. 1.

FIG. 6 is a sectional view taken along line 6—6 of FIG. 5.

For a better understanding of the invention reference is made to the following detailed description of the preferred embodiments thereof which should be referenced to prior described drawings.

DETAILED DESCRIPTION OF THE PREFERRED EMBODIMENTS

Various aspects of the present invention will evolve from the following detailed description of the preferred embodiments thereof which should be taken in conjunction with the hereinbefore described drawings.

Figure 1:
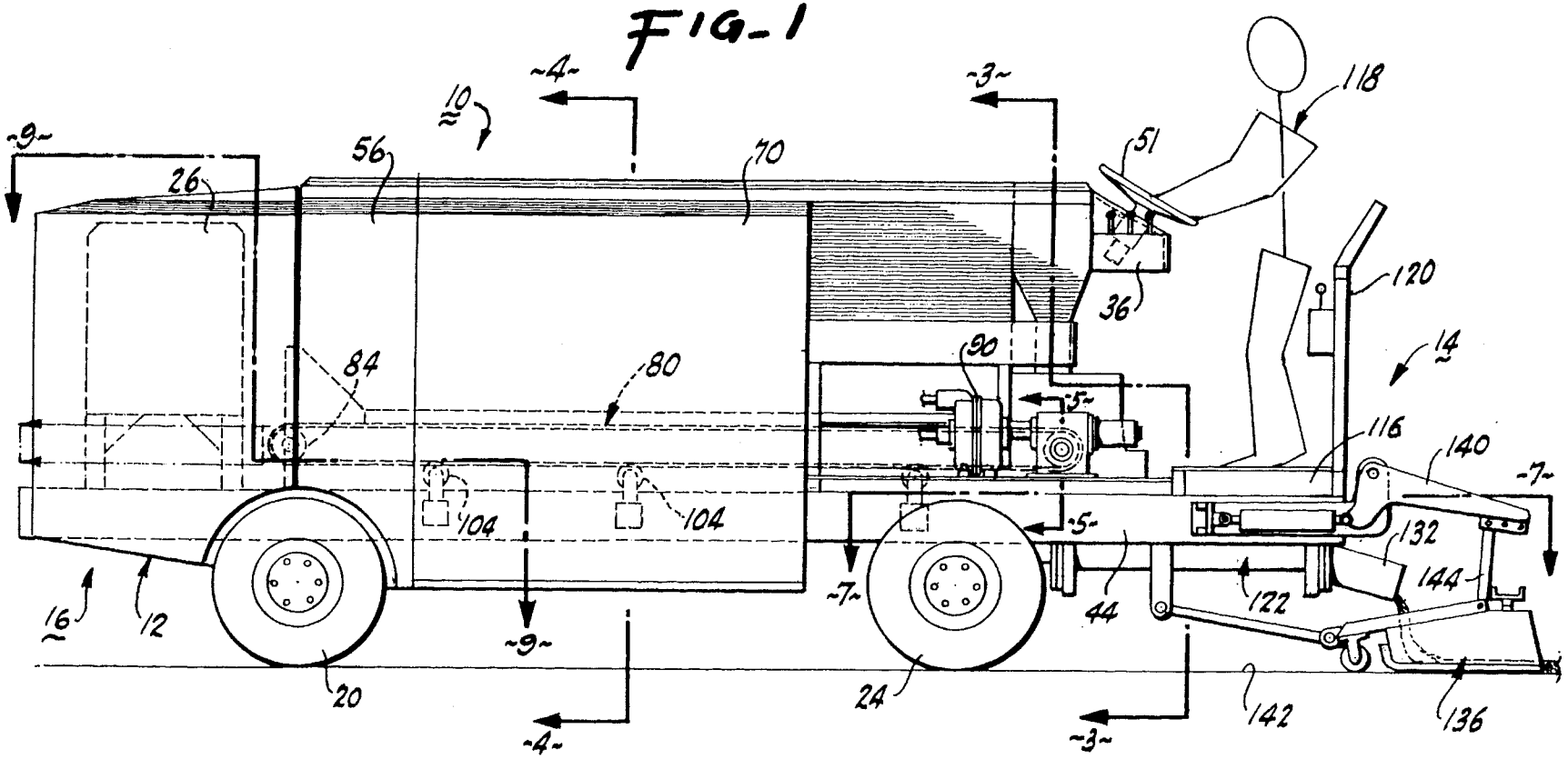
FIG. 1 is a side elevational view of the paving apparatus of the present invention.
Figure 2:
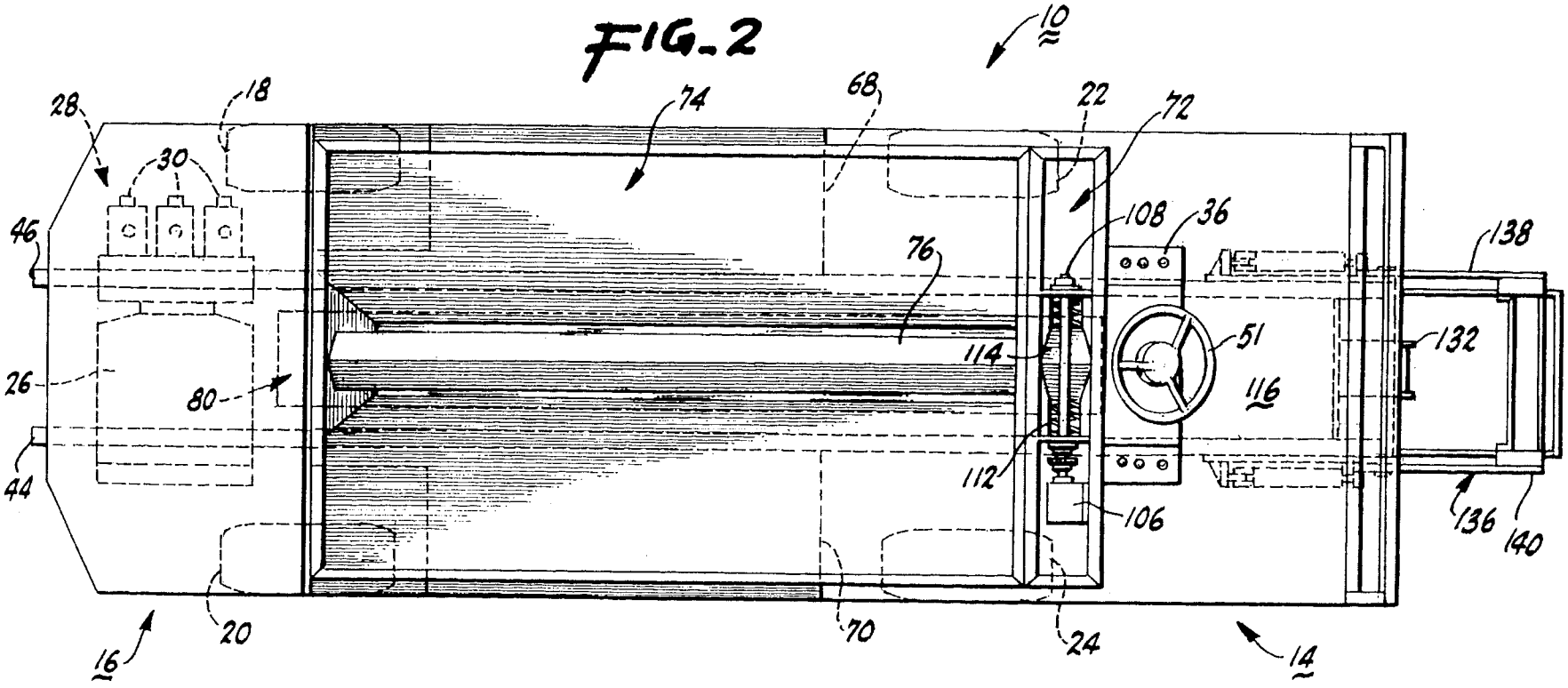
FIG. 2 is a top plan view of the paving apparatus of the present invention.

The invention as a whole is shown in the drawings by reference character 10. The paving machine 10 includes as one of its components a movable platform 12, best shown in FIGS. 1, 7, and 9. Movable platform 12 includes a first portion 14 and a second portion 16. Axially rotatable wheels 18, 20, 22, and 24 permit the movement of movable platform 12. Motor 26 located at second end portion 16, motivates hydraulic system 28 and the operation of plurality of hydraulic pumps 30, FIG. 2. Motor 26 may be a diesel engine such as John Deere turbo charged diesel, 110 horse power, 2500 RPM type. Hydraulic lines run from hydraulic pumps 30 to wheel drive motors 32 and 34 on wheels 22 and 24 at first end portion 14 of movable platform 12, FIG. 7 (not shown). Controller 36 includes a speed control and direction of turn control which rotates wheels 22 and 24 as desired by the operator. Controller 36 is located at first end portion 14 of movable platform 12.

Figure 9:
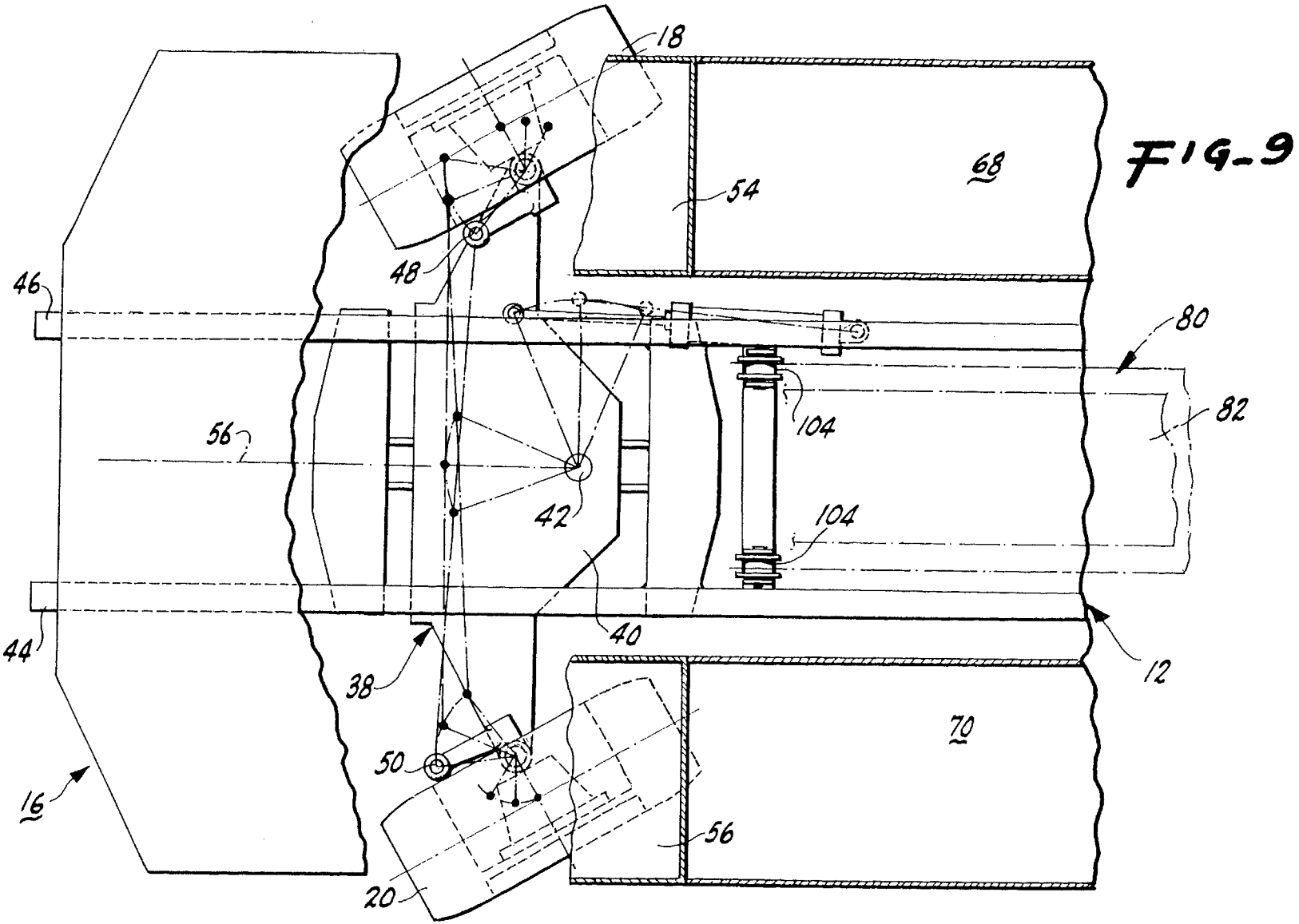
FIG. 9 is a sectional view taken along line 9—9 of FIG. 1.

With reference to FIG. 9, it may be observed that control means 36 also includes steering mechanism 38, best shown in FIG. 9. Wheels 18 and 20 at second end portion 16 are connected to an axle 40 which is fixed to rails 44 and 46 of platform 12. Ball joints 48 and 50 turn wheels 18 and 20 as desired through steering wheel 51 located at first end portion 14 of movable platform 12. Again, the hydraulic lines are not depicted for the sake of simplicity in FIG. 9. However, such hydraulic steering system is known in the art. In this regard, hydraulic tanks 54 and 56 are depicted in FIG. 9 in part. It should also be noted that vertical pivot 56 represents the axis of rotation about which wheels 18 and 20 may move vertically relative to one another. With reference to FIG. 4, axle pivot 58 is depicted and wheels 18 and 20 are depicted in phantom to emphasize such vertical off-set movement.

Figure 3:
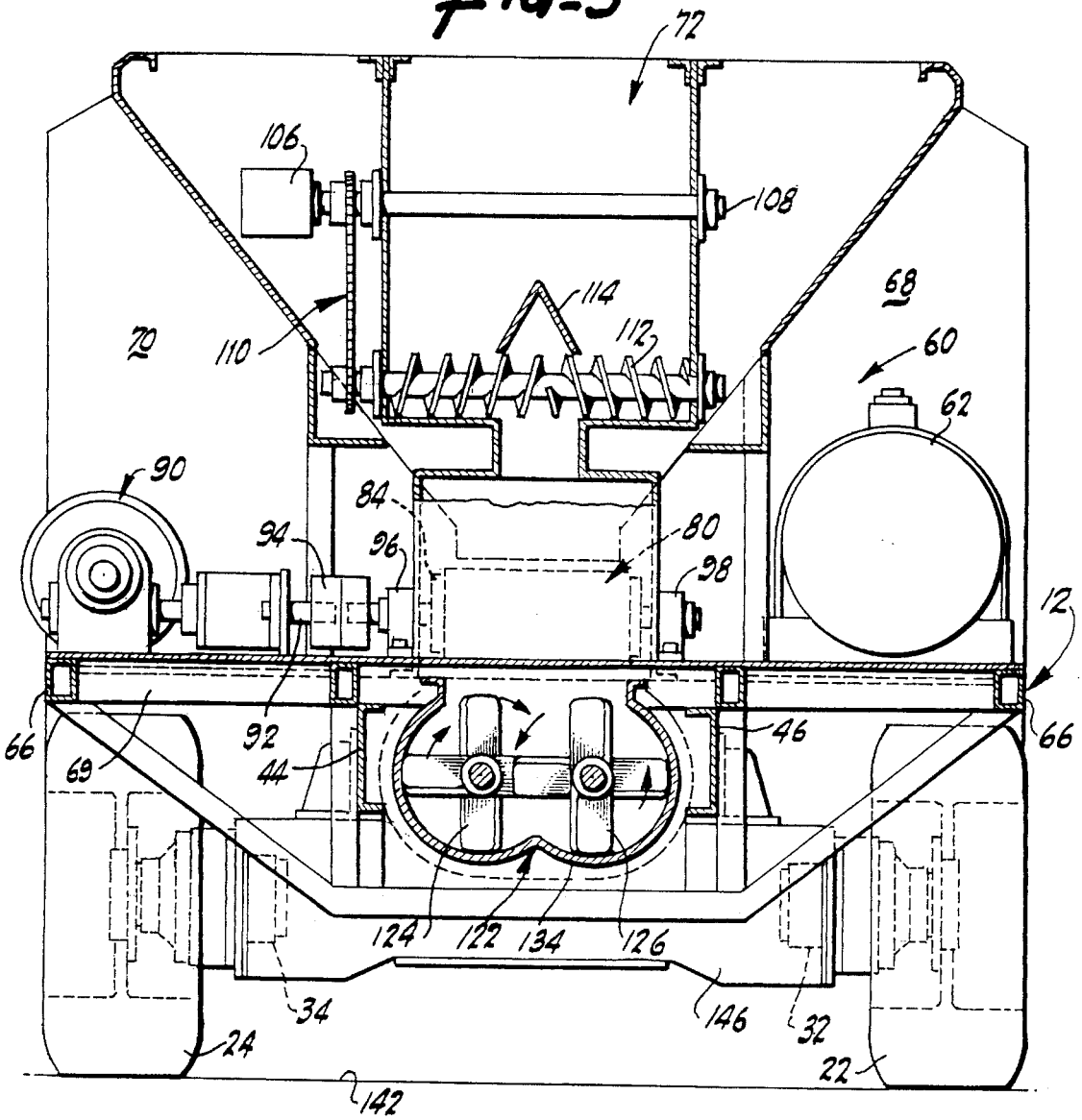
FIG. 3 is a sectional view taken along line 3—3 of FIG. 1.

Apparatus 10 also includes a plurality of containers 60 for storing paving materials, FIG. 3. For example, additive tank 62 is located above rails 46 and 64. Rails 66 also support platform 12 in this regard. Turning again to FIG. 9, water tank 68 and emulsion tank 70 are depicted. It should be noted that rails 44 and 46 span across members 67 and 69. Noting again FIG. 1, fines tank 72 is shown. Hopper 74 is open at the top and accepts aggregate and the various components such as water, emulsion, fine feeds, and the like, since hopper 74 serves as a holding tank in communication with plurality of containers 60. The specific feed lines and valves connecting plurality of containers 60 to hopper 74 have been omitted from the drawings for the sake of clarity, but are of conventional construction. Turning again to FIG. 4, hopper 74 includes a vibrator 76 to aid in the mixing of aggregate and the various components found in plurality of containers 60. It should be noted that the mixing of such emulsion type aggregate for paving a surface is well known in the art. Vibrator 76 intercepts aggregate and any other components mixed with aggregate prior to exiting mouth 78 of hopper 74.

Figure 5:
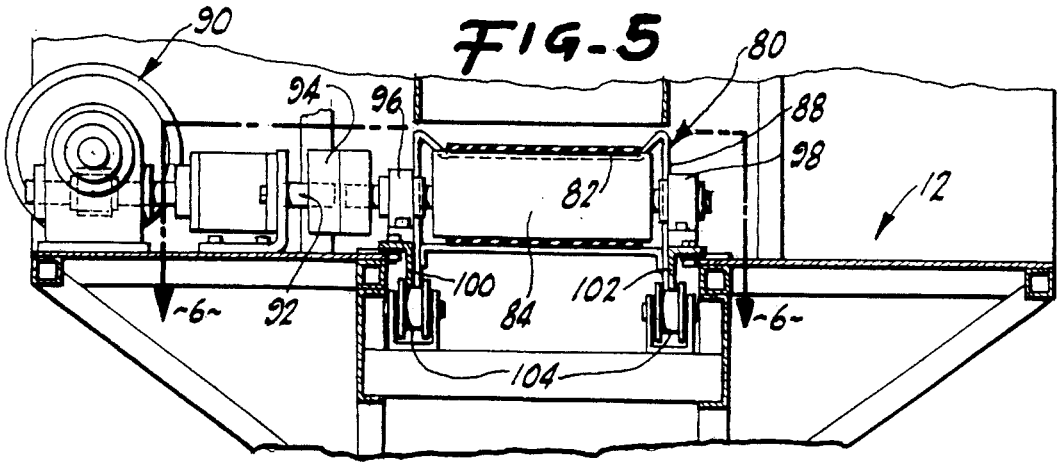
FIG. 5 is a broken sectional view taken along line 5—5 of FIG. 1.

The mixed components pass from hopper 74 onto conveyor 80 which is supported by movable platform 12. With reference to FIGS. 3, 4, and 5, conveyor 80 is best shown. In essence, conveyor 80 generally moves paving components from second portion 16 of movable platform to first portion 14 of movable platform. With reference to FIG. 4, conveyor 80 includes a conveyor belt 82 which is in the form of an endless loop which contacts a pair of rollers 84. Roller 86 of pair of rollers 84 is depicted on FIG. 4. Flat bed 88 extends the length of conveyor 80 and offers support to conveyor belt 82. Hydraulic pump 90, FIG. 3, turns roller 92 of pair of rollers 84 through a coupling 94. Bearings 96 and 98 support roller 92. With reference to FIG. 4, it may be observed that channels 100 and 102 hold by support bed 88 in place. Channels 100 and 102 are capable of sliding along a plurality of support rollers 104 which permit the removal of conveyor bed 88 and connected components through first end 14 of movable platform 12. FIG. 6 provides further detail of the roller conveyor interaction depicted in FIG. 5. It should be noted, however, that coupling 94 has been removed in FIG. 6, but appears in phantom therein.

With reference to FIG. 3, it may be observed that fines feeder 72 is shown. Hydraulic fine drive motor 106 rotates shaft 108 which is held to the walls of fine feeder 72. Belt 110 connects to fines auger 112 which directs the fines onto the top of conveyor belt 82 of conveyor 80. Diverter 114 aids in the even spreading of the fines egressing from fine feeder 72.

Stand 116 lies atop rails 44 and 46 and provides a place for operator 118 (stick figure in FIG. 1) to operate apparatus 10. Stand 116 includes an upright fence 120 which may also serve as a place for controls forming part of controlling means 36.

Figures 7, 8:
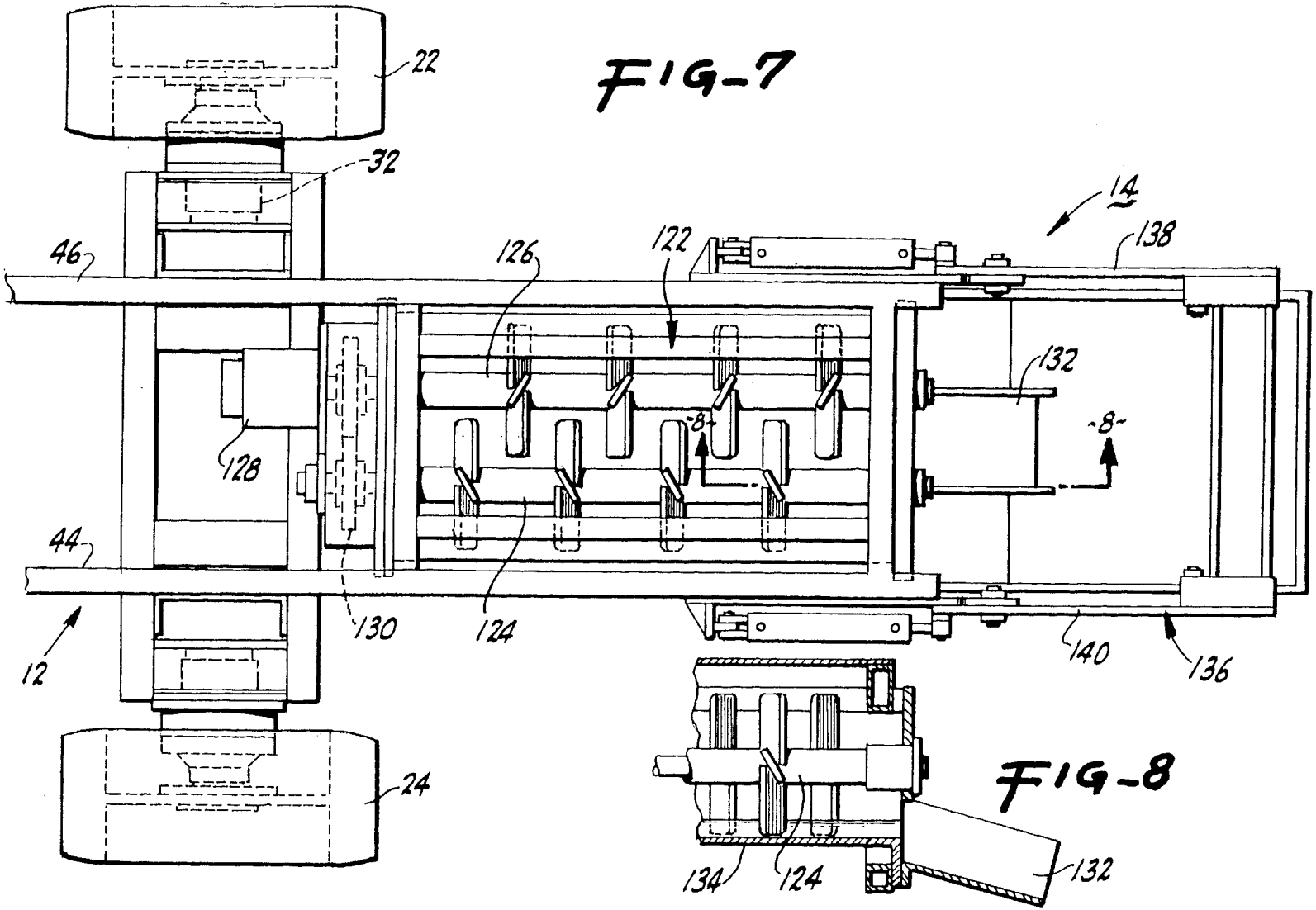
FIG. 7 is a sectional view taken along line 7—7 of FIG. 1.
FIG. 8 is a sectional view taken along line 8—8 of FIG. 7.

Paving components exiting conveyor 80 passed to pug mill 122, FIGS. 3, 7, and 8. Pug mill 122 comprises a pair of counter rotating augers 124 and 126 which are driven by hydraulic motor 128 through gear drive 130, FIG. 7. That is to say, material exiting conveyor 80 are dropped into pug mill 122 beneath stand 116. Thus, operator 118 possesses an excellent view of paving components passing from shoot 132 which serves as the exit from pug mill 122. Housing 134 confines the paving material to pug mill 122 prior to entering outlet 132. Pug mill 122 is supported to rail structures 44 and 46.

Spreader box 136 distributes the paving components on the surface to be paved. Spreader box 136 includes lift arms 138 and 140 which permit the moving of spreader box 136 upwardly from surface 142 when apparatus 10 is moving thereamong. Linkage 144 connects spreader box 136 to lift arms 138 and 140 in this regard. It should be noted that spreader box 136 and pug mill 122 remain clear of axle 146 for wheels 22 and 24.

In operation, the user or operator 118 takes the position on stand 116 at first end portion 14 of movable platform 12 in the present apparatus 10. The speed and direction of apparatus 10 is controlled through controller 36 by a multiplicity of hydraulic controls known in the art. Steering wheel 51 directs wheels 18 and 20 left or right according to steering mechanism 38. Axle pivot 58 permits vertical differentiations between wheels 18 and 20, FIG. 4. Paving components are placed in hopper 74 either directly or fed thereto through conduits and valves (not shown) controlled by operator 118. For example, aggregates, water, emulsion, and additives are placed into hopper 74. Fines are also fed into hopper 74 near first end portion 14 of movable platform 12 and mixed through auger 112. Conveyor 80 then passes mixed components into pug mill 122 which thoroughly distributes the components before passing the same into chute 132 and spreader box 136 for use on surface 142. Operator 118 may operate apparatus 10 single handedly from stand 116 through appropriate controls known in the hydraulic arts which are placed at controller 36 and on upright 120. Spreader box 136 may be moved upwardly and downwardly by operating lifter arms 138 and 140 to permit apparatus 10 to move more quickly along surface 142 and laying paving components.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A paving apparatus workable by a single operator utilizing a plurality of surface paving components, comprising:

a. a movable platform, said movable platform including a first end portion and a second end portion;

b. a plurality of containers supported on said platform, said plurality of containers permitting storage of the plurality of surface paving components;

c. a conveyor supported by said platform, said conveyor being capable of moving paving components from said first end portion to said second end portion;

d. a holding tank capable of communicating with said plurality of containers for combining said plurality of surface paving components, said conveyor located at said holding tank to transport said combined plurality of surface paving components;

e. an operator stand located at said first end portion of said movable platform;

f. mixing means for blending said plurality of surface paving components, said mixing means including an inlet communicating with said conveyor at said first end portion of said movable platform and an outlet for directing said mixed surface paving components to a surface, said mixing means located at said first end portion of said movable platform adjacent said operator stand;

g. control means for determining the rate of speed at said movable platform for steering said movable platform, said control means located at said first end portion of said movable platform adjacent said operator stand; and h. motor means for urging movement of said movable platform.

2. The paving apparatus of claim 1 in which said motor means is located at said second end of said movable platform.

3. The paving apparatus of claim 1 which additionally comprises a spreader box, said spreader box being positioned to receive mixed surface paving components from said mixing means.

4. The paving apparatus of claim 3 in which said mixing means is a plug mill.

5. The paving apparatus of claim 4 in which said pug mill includes a pair of augers.

6. The paving apparatus of claim 3 which additionally comprises lifting means for vertically moving said spreader box.

7. The paving apparatus of claim 6 in which said lifting means includes a control actuator located at said operator stand.

8. The paving apparatus of claim 7 in which said lifting means includes a lifter arm and hydraulic means for operating said lifter arm of said control actuator being linked to said control actuator.

9. The paving apparatus of claim 1 in which said control means includes a hydraulic steering mechanism.

10. The paving apparatus of claim 1 which additionally comprises an auger for feeding fines to said conveyor.

* * * * *